US006114471A

United States Patent [19]

Owens et al.

[11] Patent Number: 6,114,471

[45] Date of Patent: Sep. 5, 2000

[54] STRENGTHENING COMPOSITIONS AND TREATMENTS FOR LIGNOCELLULOSIC MATERIALS

[75] Inventors: Blair Alex Owens, Fairfield; Dimitris Ioannis Collias, Mason; Andrew Julian Wnuk, Wyoming, all of Ohio

[73] Assignee: The Proctor & Gamble Company, Cincinnati, Ohio

[21] Appl. No.: 09/190,903

[22] Filed: Nov. 12, 1998

[51] Int. Cl.[7] ..... C08F 283/04; C08G 59/00; C08G 61/00; C08G 69/26

[52] U.S. Cl. ..... 525/420; 525/54.4; 528/332; 528/397; 528/403; 528/423; 528/492; 162/167; 162/168.2

[58] Field of Search ..... 525/54.4, 420; 528/332, 397, 403, 423, 492; 162/167, 168.2

[56] References Cited

U.S. PATENT DOCUMENTS

| | | | |
|---|---|---|---|
| 2,926,116 | 2/1960 | Keim . | |
| 3,332,901 | 7/1967 | Keim . | |
| 3,849,184 | 11/1974 | Roberts . | |
| 3,982,993 | 9/1976 | Fift | 162/158 |
| 4,240,935 | 12/1980 | Dumas . | |
| 5,120,773 | 6/1992 | Fischer et al. | 523/400 |
| 5,239,047 | 8/1993 | Devore et al. | 528/339.3 |
| 5,338,404 | 8/1994 | Lucas et al. | 162/163 |
| 5,456,800 | 10/1995 | Tansley et al. | 162/158 |
| 5,510,004 | 4/1996 | Allen | 162/168.2 |
| 5,585,456 | 12/1996 | Dulany et al. | 528/332 |

FOREIGN PATENT DOCUMENTS 0 418 015 A1 3/1991 European Pat. Off. .

WO 98/24974 6/1998 WIPO .

OTHER PUBLICATIONS

Robert W. Hagemeyer et al.: "Pulp and Paper Manufacture, 3rd edition, vol. 6" 1992, The Joint Textbook Committee of the Paper Industry, Tappi, CPPA, Montreal, Canada XP002128021–pp.65—85 (H.H. Espy: "Wet –strengh resins").

Database WPI–Section Ch, Week 199347: Derwent Publications Ltd., London,GB; Class A28, An 1975–79396W XP002128022 & SU 1 773 925 A (Below Chem Articles Prodn Assoc), Nov. 11, 1992 (1992–11–07) abstract.

Database WPI–Section Ch, Week 19938: Derwent Publications Ltd., London,GB: Class A28, An 1975–79396W XP002128024 & JP 50 076308 A (Sumitomo Chem Co Ltd) Jun. 23, 1975 (1975–06–23) abstract.

Database WPI–Section Ch, Week of 199124: Derwent Publications Ltd., London, GB; Class A82, An 1991–176285 XP002128023 & SU 1 581 465 A Mariupol Metallurgy, Jul. 30, 1990 (1990–07–30) abstract.

*Primary Examiner*—Nathan M. Nutter
*Attorney, Agent, or Firm*—Jack L. Oney, Jr.; Leonard W. Lewis

[57] ABSTRACT

The strength of lignocellulosic materials is improved by treating them with water-soluble strengthening agents containing sulfonic units, and rendering these agents water-insoluble by reacting them with compounds containing azetidinium rings. Thus, a substantial reduction or elimination of the bleeding of said strengthening agents from the lignocellulosic materials when touched with wet hands or contacted under humid conditions is achieved.

16 Claims, No Drawings

STRENGTHENING COMPOSITIONS AND TREATMENTS FOR LIGNOCELLULOSIC MATERIALS

FIELD OF THE INVENTION

The present invention relates to products and processes to improve the strength of lignocellulosic materials.

BACKGROUND OF THE INVENTION

Lignocellulosic materials, such as paper and cardboard, can be strengthened by treating them (e.g. coating, impregnating, etc.) with solutions or dispersions of various strengthening agents. Examples of these solutions or dispersions are aqueous solutions of lignosulfonates. Lignosulfonates are metal or ammonium salts of lignosulfonic acids. The lignosulfonates are either by-products of the sulfite pulping process, or products of sulfonation of other lignin derivatives. Lignin derivatives include, but are not limited to, kraft lignin, organosolv lignin, chemically modified lignin derivatives, and mixtures thereof. However, one major problem with using these strengthening agents is that they bleed off the lignocellulosic materials when touched with wet hands. This results in poor aesthetics and increased messiness. Another major problem is that these strengthening agents exhibit low retention of strength at high humidity compared to that at normal humidity (e.g. 50% RH). Again, this problem is expected to be caused by their high affinity to water and moisture.

One common method to increase the strength of the lignocellulosic material under high humidity conditions is to add additional fiber to the material. However, this method is not cost effective as well because of the additional fiber/material costs. Another method to eliminate or reduce the bleeding of the water-soluble strengthening agents is to coat the treated lignocellulosic materials with wax or polymer films. However, this method is not an effective solution because the secondary coating materials are expensive to purchase, process, and apply, and typically not repulpable under normal conditions.

Yet another method to eliminate or reduce bleeding of the water-soluble strengthening agents is to insolubilize them by crosslinking. In the case of lignosulfonates the crosslinking reactions that have been reported in the literature include the following: condensation reaction with strong mineral acids at elevated temperatures (via the $SO_3^{2-}$ units), oxidative coupling reaction with hydrogen peroxide and catalysts (via the $OH^-$ groups), reaction with bis-diazonium salts (via the $\alpha$-position to the $OH^-$ groups), reaction with bifunctional acid chlorides (via the $OH^-$ groups), reaction with cyanuric chloride (via the $OH^-$ groups), reaction with formaldehyde (via the $CH_2$ groups), reaction with furfural (via the $\alpha$-position to the $OH^-$ groups), and reaction with epichlorohydrin (via the $OH^-$ groups). However, the above reactions/processes include various processing problems, such as cost, low pH, long reaction times, harsh conditions (e.g. temperature), health hazards, etc.

What has been missing is an inexpensive product and a simple, inexpensive, and fast process to improve the strength of treated lignocellulosic materials under humid conditions by reacting the water-soluble strengthening agents so as to substantially reduce or eliminate the bleeding of the water-soluble strengthening agents from the material when touched with wet hands or contacted under humid conditions.

SUMMARY OF THE INVENTION

The present invention relates to products and processes to improve the strength of lignocellulosic materials. The strength improvement is achieved by treating the lignocellulosic materials with water-soluble strengthening agents having at least one sulfonic unit and rendering these agents water-insoluble by reacting them with compounds having at least one azetidinium ring. This results in a substantial reduction or elimination of the bleeding problem of the originally watersoluble strengthening agents from the lignocellulosic materials when touched with wet hands or contacted under humid conditions.

DETAILED DESCRIPTION OF THE INVENTION

It is known that the strength of lignocellulosic materials (e.g. paper, linerboard, corrugated, cartonboard, etc.) can be improved by treating them with various aqueous solutions of strengthening agents (e.g. sodium silicate, starch, carboxy methyl cellulose—CMC, xylan, etc.). Unfortunately, these water-soluble strengthening agents bleed off the materials when touched by wet hands or contacted under humid conditions.

Lignosulfonates are water-soluble strengthening agents that can also be used to strengthen lignocellulosic materials. The lignosulfonates contain sulfonic units ($HSO_3^-$; also called hydrogen sulfite units) and sulfonate units ($SO_3^{2-}$; also called sulfite units), and for the purposes of this disclosure the term "sulfonic" will be used to encompass both "sulfonic" and "sulfonate" units. It is expected that the lignosulfonates strengthen the lignocellulosic materials by reinforcing their fibers and/or fiber bonds, via encapsulation and/or penetration. Lignosulfonates are examples of a variety of possible lignin derivatives which may be used. Lignin derivatives include, but are not limited to, kraft lignin, organosolv lignin, chemically modified lignin derivatives wherein the nucleophilic sulfonic unit is preserved, and mixtures thereof.

Unexpectedly it was found that an aqueous calcium lignosulfonate solution (LIGNOSITE 50 containing 40% calcium lignosulfonate and 10% inert solids; from Georgia-Pacific Inc.; Atlanta, Ga.) when mixed together with an aqueous KYMENE solution (KYMENE 557LX containing 12.5% solids; from Hercules Inc.; Wilmington, Del.) exhibits a virtually instantaneous reaction that results in a precipitate. This precipitate exhibits water-insoluble properties. This mixing is a simple, inexpensive, and fast process that is carried out under ambient conditions and without the need for complex pieces of equipment. It was also unexpectedly found that aqueous sodium lignosulfonate (LIGNOSITE 458 from Georgia-Pacific Inc.) and ammonium lignosulfonate (LIGNOSITE 1740) when independently mixed together with an aqueous KYMENE solution (KYMENE 557LX containing 12.5% solids; from Hercules Inc.) exhibit a virtually instantaneous reaction that results in a precipitate.

KYMENE is a polyamine polyamide epichlorohydrin {also referred to as a) polyaminoamide epichlohydrin, b) poly(aminoamide) epichlorohydrin, c) amino polyamide epichlorohydrin, d) polyamide epichlorohydrin, or e) PAE } compound that is used as a wet-strength agent in paper applications. Preparation of KYMENE is described in great detail in Keim, U.S. Pat. No. 2,926,116, issued Feb. 23, 1960; and Keim, U.S. Pat. No. 3,332,901, issued Jul. 25, 1967. Although it is known that KYMENE has a strong affinity for itself (as it crosslinks primarily with itself) and a slight affinity for cellulose or CMC (via the cellulose's carboxyl groups), it has never been disclosed or found that KYMENE has a strong affinity for lignosulfonates.

One commercial source of a useful polyamide-polyamine-epichlorohydrin compound is Hercules, Inc. of Wilmington, Del., which markets such a compound under the trademark KYMENE 557H, as referenced in U.S. Pat. No. 2,926,116. Other KYMENE products have the extension 557LX, SLX, SLX2, or ULX. Another commercial source of a useful polyamide-polyamine-epichlorohydrin compound is the Henkel Corporation, which markets such compound under the trademark Fibrabond, as referenced in U.S. Pat. No. 5,239,047. Another possibly useful compound which contains azetidinium rings (not currently commercially available) is described in U.S. Pat. No. 5,510,004, assigned to Hercules Incorporated, and issued on Apr. 23, 1996.

Without wishing to be bound by theory, it is hypothesized that the crosslinking takes place between the highly nucleophilic sulfonic or sulfonate units of the lignosulfonate and the azetidinium rings ($—N^+—(CH_2)_2—CH—OH$) of KYMENE. Furthermore, it is believed that 3-D molecular conformations, active unit spacings and number density, and steric effects play important roles in determining the strength of the crosslinking association.

The above hypotheses were tested in various series of experiments. In the first series, various lignosulfonate solutions were tested with KYMENE to determine which ones react similarly to LIGNOSITE 50. Out of the 32 lignosulfonate solutions supplied by Westvaco Inc. (New York, N.Y.), Lignotech Inc. (Bridgewater, N.J.), and Georgia-Pacific only 9 (Westvaco's REAX 83A, Lignotech's WANIN S, Lignotech's NORLIG G, Lignotech's MARASPERSE N-22, Lignotech's WELLTEX 200, Lignotech's WELLTEX 300, Lignotech's WELLTEX 300F, Georgia-Pacific's LIGNOSITE 1740, and Georgia-Pacific's LIGNOSITE 458) formed a precipitate similar to that of LIGNOSITE 50. In another series of experiments, kraft lignin (Indulin AT from Westvaco Inc.), which has hydroxyl but not sulfonic/sulfonate units, could not form a precipitate with KYMENE. In yet another series of experiments, polystyrene sulfonate (from Aldrich Inc.), which has sulfonic but not hydroxyl units, was combined with KYMENE and resulted in a precipitate. However, polyvinyl sulfonate (from Aldrich Inc.) did not form a precipitate when combined with KYMENE. All the above experiments point to the fact that the existence of the sulfonic/sulfonate units in a compound is a necessary but not a sufficient condition for a reaction between this compound and KYMENE to form a precipitate. Therefore, besides the sulfonic/sulfonate units, the above experiments indicate that 3-D molecular conformations, active unit spacings and number density, and steric effects play a decisive role in the existence or absence, and strength of the precipitate.

On the other hand, the importance of the azetidinium ring in KYMENE with respect to the reaction mechanism was tested by attempting to react poly diallyldimethylammonium chloride (i.e., a quaternary amine) having a molecular weight of about 100,000 to 200,000 with lignosulfonate. The resulting product was a thickened slurry of the two polymeric compounds, unlike the precipitate between lignosulfonate and KYMENE. Furthermore, other polymeric amines, such as polyethylenimine (PEI), were reacted with lignosulfonate producing a similar water-soluble thickened slurry.

In another series of experiments, it was discovered that the precipitate between lignosulfonate and KYMENE will only stay water-insoluble within a certain pH range. More specifically, it was discovered that certain alkaline conditions, which may be dependent upon the compounds reacted, will solubilize the precipitate. For example, the precipitate from the reaction of calcium lignosulfonate (LIGNOSITE 50 from Georgia-Pacific Inc.) and KYMENE 557LX (from Hercules Inc.) will solubilize in a water solution if the pH is about 11 or higher.

This crosslinking reaction and treatment can be applied to the lignocellulosic materials at any stage of the material manufacturing process, including the pulp stage, wet end of the paper making process (e.g. in the headbox, or formation section, or press section), and dry end (e.g. in the drying section or size press), or even to dry material already processed (e.g. linerboard, and medium) and formed into final products (e.g. corrugated board). In general, there are two methods to form the precipitate and apply it to the lignocellulosic materials.

In the first method, the precipitate is formed in the lignocellulosic material (also called in-situ method) and in the second method the precipitate is pre-formed and then applied to the lignocellulosic material. In one variation of the in-situ method, the water-soluble strengthening agent having at least one nucleophilic sulfonic unit is applied to the lignocellulosic material first and the compound having at least one azetidinium ring is applied second. In another variation of the in-situ method, the compound having at least one azetidinium ring is applied to the lignocellulosic material first, and the water-soluble strengthening agent having at least one nucleophilic sulfonic unit is applied second. Various methods may be used to apply both the compound having at least one azetidinium ring and the water-soluble strengthening agent having at least one nucleophilic sulfonic unit. Such methods of application include, but are not limited to, immersion, coating, and incorporation by pressure (e.g. MIPLY pressure saturation method; U.S. Pat. No. 4,588,616 herein incorporated by reference). The chosen method to apply the compound having at least one azetidinium ring need not be the same as the chosen method to apply the water-soluble strengthening agent having at least one nucleophilic sulfonic unit.

The in-situ method can be used for a single lignocellulosic material as well as for a laminate structure of plies of lignocellulosic materials. In the latter case, the compound containing the sulfonic units and the compound containing the azetidinium rings can be applied on the same ply or on two subsequent plies or between two plies. Note that when the compound containing the sulfonic units is applied to one ply and the compound containing the azetidinium rings is applied to the subsequent ply, the precipitate that is formed between the plies performs well as a water-resistant adhesive.

In the second method, the precipitate is formed first by mixing a compound having at least one azetidinium ring and a water-soluble strengthening agent having at least one nucleophilic sulfonic unit and then it is applied to a lignocellulosic material. Similarly to the in-situ method, this method can be used for a single lignocellulosic material as well as for a laminate structure of plies of lignocellulosic materials. In the latter case, the precipitate can be applied to a single ply or between two plies. Note that when the precipitate is applied between two plies, it also performs well as a water-resistant adhesive.

Lignosulfonate may be used in either solid form (e.g. powder) or liquid form (e.g. solution or dispersion in water, or mixtures of water and organic solvents). For example, lignosulfonate powder (e.g. LIGNOSITE 100 from Georgia-Pacific) can be mixed with an aqueous KYMENE solution and result in a precipitate, similar to the precipitate resulting from the mixture of lignosulfonate and KYMENE solutions. Similarly, the KYMENE can be used either in the solid form (e.g. powder) or liquid form (e.g. solution or dispersion in water, or mixtures of water and organic solvents).

In general, the solvent or dispersant of the solution or dispersion of the strengthening agents may or may not contain water, i.e., it can be totally aqueous, or totally organic, or it can contain mixtures of water and organic solvents. Furthermore, the strengthening agents can be in pure form or in mixtures with other inert or active agents.

The substantial reduction or elimination of bleeding of lignosulfonate from lignosulfonate-KYMENE treated paper, as well as the high retention of strength in high humidity for lignosulfonate-KYMENE treated paper are shown in the following three examples.

EXAMPLE 1

The elimination of bleeding is checked by submerging paper samples in water for a period of several days. Two sets of samples are prepared. The first set of samples are made using 35# linerboard (i.e., 35 pounds per thousand square feet; 35 lb/msf; 170 g/m$^2$ or 170 grams per square meter; product USP70 from Georgia-Pacific Inc.) dipped into an aqueous solution of calcium lignosulfonate (LIGNOSITE 50 from Georgia-Pacific Inc.; 40% lignosulfonate solids and 10% inert solids) for 1 minute. The second set of samples are made using 35# linerboard dipped first into an aqueous solution of calcium lignosulfonate for 1 minute, then wiped free of excess aqueous solution, and then dipped into an aqueous solution of 5.0% KYMENE 557LX (from Hercules Inc.) for 10 seconds. Both sets of samples are dried between two heated platens at 177° C. for 10 seconds. Both sets of samples are then submerged in water at room temperature for a period of at least three days. The water around the lignosulfonate treated samples turns dark brown indicating that amounts of lignosulfonate bleed from the samples. However, the water around the lignosulfonate-KYMENE treated samples remains clear indicating that no lignosulfonate bleeds from the samples.

EXAMPLE 2

In an experiment designed to determine the humidity resistance of lignosulfonate-KYMENE treated linerboard at 80% RH, 35# linerboard (product USP70 from Georgia-Pacific Inc.) is first treated with calcium lignosulfonate and then treated with KYMENE as in Example 1. The strength of this lignosulfonate-KYMENE treated linerboard is then tested by conducting a Ring Crush test (RCT; TAPPI standard T822-om93), wherein, the lignosulfonate-KYMENE treated linerboard exhibits a value of 66.1±3.9 lbf/6 in. The respective RCT test value for the same linerboard treated with calcium lignosulfonate only (as in Example 1) is 61.7±3.7 lbf/6 in. Therefore, it is concluded that when linerboard is treated with lignosulfonate and KYMENE, the lignosulfonate-KYMENE treated linerboard exhibits a 7% increase in strength (which is statistically significant at the 99% confidence level) at 80% RH compared to lignosulfonate treated linerboard.

EXAMPLE 3

In another series of experiments, designed to determine the effect of the treatments on box compression, various RSC-type (regular slotted containers) corrugated boxes (in C-flute configuration) with length of 28 cm (11 in.), width of 21.6 cm (8.5 in.), height of 20.3 cm (8 in.), and flaps of width 5 cm (2 in.) are made. Three series of boxes are made. The first series is made with untreated linerboards and medium (control boxes). The linerboard is 35# (product USP70 from Georgia-Pacific Inc.) and the medium is 26# (127 gsm; from Georgia-Pacific Inc.). The basis weight of the control corrugated board is 573 gsm. The next two series are made with treated 35# linerboards and untreated 26# medium. In the second series, the linerboards are treated with an aqueous solution of calcium lignosulfonate (LIGNOSITE 50 from Georgia-Pacific Inc.; 40% lignosulfonate solids and 10% inert solids) using the MIPLY pilot-scale pressure saturator (located at Vits Maschinenbau GmbH, in Langenfeld, Germany). The level of add-on achieved is 37%, and the basis weight of the corrugated board is 683 gsm (i.e., 19% heavier than the untreated corrugated). Finally, in the third series, the linerboards are treated with calcium lignosulfonate (similar to the second series; 35% add-on) and then coated with KYMENE 557LX applied from a 12.5% solution (from Hercules Inc.) with a wire-rod (Mayer) coater (0.2 mm wire diameter; about 1% add-on). The basis weight of the corrugated board is 677 gsm (i.e., 18% heavier than the untreated corrugated). All series of boxes are tested in compression (according to TAPPI standard T804 om-89) using a Lansmont tester (model # 76-5; Lansing, Mich.) with a cross-head speed of 1.27 cm/min (0.5 in./min; 0.022 cm/s) and the peak load for a maximum compression of 2.541 cm (1 in.) is reported.

The peak loads of the untreated (control) boxes at 50% RH and 80% RH are 2711±53 N (610±12 lbf) and 2191±80 N (493±18 lbf), respectively. Similarly, the respective peak loads of the boxes made with linerboards treated with calcium lignosulfonate only are 3769±213 N (848±48 Ibf) and 2613±53 N (588±12 lbf). Finally, the respective peak loads of the boxes made with linerboards treated with both calcium lignosulfonate and KYMENE are 3782±440 N (851±99 lbf) and 2884±129 N (649±29 lbf). Therefore, it is concluded that when corrugated boxes are made with linerboards treated with calcium lignosulfonate and KYMENE, the treated boxes exhibit a 10% increase in strength at 80% RH compared to corrugated boxes made with linerboards treated with calcium lignosulfonate only.

Treated lignocellulosic materials with the disclosed lignosulfonate and KYMENE combination were also tested for repulpability and proved to be repulpable under mild conditions, as shown in the following example.

EXAMPLE 4

The repulpability test consists of three steps. The first step is the disintegration of the paper samples in the disintegrator, the second step is the formation of handsheets from the disintegrated samples, and the third step is the inspection and analysis of the formed handsheets. Three samples are evaluated in this repulpability study: 1) control 35# linerboard (product USP70 from Georgia-Pacific Inc.), 2) 35# linerboard impregnated with calcium lignosulfonate (LIGNOSITE 50 from Georgia-Pacific Inc.; about 22% add-on) using MIPLY's pressure saturator, and 3) 35# linerboard impregnated with calcium lignosulfonate (28% add-on) using MIPLY's pressure saturator, and post-coated with KYMENE 557LX reagent (from Hercules Inc.) using a 0.2 mm diameter Mayer bar (about 1% add-on).

In the disintegration step, a TAPPI/British disintegrator (TAPPI T-205) is operated for 9 minutes with 125 ml samples removed at each minute. The disintegrator is equipped with spiral baffles, fitted with a 3,000 rpm three-bladed propeller, and filled with de-ionized water (pH=7.4) at 38° C.±6° C. (100° F.±10° F.).

The samples from the disintegration step are then formed into handsheets within the formation step. The samples from the first minute of the disintegration step are discarded because they have not been sufficiently disintegrated. The remaining eight samples from the disintegration step are formed into eight handsheets, respectively, using a Noble & Wood Handsheet machine.

In the inspection and analysis step, the total of 24 handsheets is inspected, and analyzed with the M/K Formation Tester. The inspection is first visual and then the sheets are evaluated using a Microformation tester and Floc/Void size analyzer from M/K Systems Inc. The Microformation Tester and Floc/Void analyzer measure the following four properties of sheet formation: 1) Formation Index—a measure of the uniformity of the handsheet, the higher the index value equates to better uniformity, 2) Percent Floc Index—the percent of the handsheet determined to be undefibered scrape, 3) Average Floc Size Index—the size of the undefibered scrap, and 4) Floc Intensity Index—the difference in the basis weight of the floe areas and the remainder of the handsheet.

The conclusion from the visual inspection of the handsheets is that all the samples are repulpable when the conditions specified above are used. Furthermore, linerboards impregnated with calcium lignosulfonate and calcium lignosulfonate/KYMENE (i.e., samples #2 and #3) repulp and form more uniform handsheets than the control (i.e., sample #1). Finally, all indices support the general trend observed through visual inspection that the handsheets which are formed from the repulped impregnated linerboards are as uniform or more uniform than the control handsheets. Overall, the conclusion is that treated lignocellulosic materials with the disclosed lignosulfonate and KYMENE combination are repulpable under the same mild conditions used for repulping untreated lignocellulosic materials.

We claim:

1. A product added to lignocellulosic material to improve the strength under humid conditions of said material, said product comprising:

a) a water-soluble strengthening agent having at least one nucleophilic sulfonic unit; and b) a compound having at least one azetidinium ring.

2. A product according to claim 1, wherein said water-soluble strengthening agent is selected from the group consisting of lignin derivatives and mixtures thereof.

3. A product according to claim 2, wherein said lignin derivatives is selected from the group consisting of metal salts of lignosulfonic acid, ammonium salts of lignosulfonic acid, and any further chemically modified lignosulfonic acid compounds wherein the nucleophilic sulfonic unit is preserved, and mixtures thereof.

4. A product according to claim 1, wherein said compound having at least one azetidinium ring is selected from the group consisting of polyamide-polyamine-epichlorohydrin compounds and mixtures thereof.

5. A method of improving the strength under humid conditions of lignocellulosic material, said method comprising the steps of:

a) applying a water-soluble strengthening agent having at least one nucleophilic sulfonic unit to the lignocellulosic material; and b) applying a compound having at least one azetidinium ring to the lignocellulosic material having said strengthening agent.

6. A method according to claim 5, wherein said water-soluble strengthening agent is selected from the group consisting of lignin derivatives and mixtures thereof.

7. A method according to claim 6, wherein said lignin derivatives is selected from the group consisting of metal salts of lignosulfonic acid, ammonium salts of lignosulfonic acid, and any further chemically modified lignosulfonic acid compounds wherein the nucleophilic sulfonic unit is preserved, and mixtures thereof.

8. A method according to claim 5, wherein said compound having at least one azetidinium ring is selected from the group consisting of polyamide-polyamine-epichlorohydrin compounds and mixtures thereof.

9. A method of improving the strength under humid conditions of lignocellulosic material, said method comprising the steps of:

a) applying a compound having at least one azetidinium ring to the lignocellulosic material; and b) applying a water-soluble strengthening agent having at least one nucleophilic sulfonic unit to the lignocellulosic material having said azetidinium ring compound.

10. A method according to claim 9, wherein said water-soluble strengthening agent is selected from the group consisting of lignin derivatives and mixtures thereof.

11. A method according to claim 10, wherein said lignin derivatives is selected from the group consisting of: metal salts of lignosulfonic acid, ammonium salts of lignosulfonic acid, and any further chemically modified lignosulfonic acid compounds wherein the nucleophilic sulfonic unit is preserved, and mixtures thereof.

12. A method according to claim 9, wherein said compound having at least one azetidinium ring is selected from the group consisting of polyamide-polyamine-epichlorohydrin compounds and mixtures thereof.

13. A method of improving the strength under humid conditions of lignocellulosic material, said method comprising the steps of:

a) mixing a compound having at least one azetidinium ring and a water-soluble strengthening agent having at least one nucleophilic sulfonic unit; and b) applying said mixture of said azetidinium ring compound and water-soluble strengthening agent to the lignocellulosic material.

14. A method according to claim 13, wherein said water-soluble strengthening agent is selected from the group consisting of lignin derivatives and mixtures thereof.

15. A product according to claim 14, wherein said lignin derivatives is selected from the group consisting of metal salts of lignosulfonic acid, ammonium salts of lignosulfonic acid, and any further chemically modified lignosulfonic acid compounds wherein the nucleophilic sulfonic unit is preserved, and mixtures thereof.

16. A method according to claim 13, wherein said compound having at least one azetidinium ring is selected from the group consisting of polyamide-polyamine-epichlorohydrin compounds and mixtures thereof.

* * * * *